United States Patent [19]

Schoonmade

[11] 4,227,687

[45] Oct. 14, 1980

[54] APPARATUS FOR SEPARATING AND REMOVING A SHEET FROM A STACK OF SUCH SHEETS

[75] Inventor: Bertus Schoonmade, Delft, Netherlands

[73] Assignee: N.V. Optische Industrie "De Oude Delft", Delft, Netherlands

[21] Appl. No.: 896,008

[22] Filed: Apr. 13, 1978

[30] Foreign Application Priority Data

Apr. 20, 1977 [NL] Netherlands ..... 7704308

[51] Int. Cl.[3] ..... B65H 3/36

[52] U.S. Cl. ..... 271/139

[58] Field of Search ..... 271/131, 133, 139, 141–144, 271/132, 137, 138

[56] References Cited

U.S. PATENT DOCUMENTS

| | | | |
|---|---|---|---|
| 2,402,774 | 6/1946 | Rice | 271/142 X |
| 2,692,774 | 10/1954 | Sidman | 271/133 |
| 3,262,698 | 7/1966 | Vander Wijngaart | 271/139 |
| 3,549,866 | 12/1970 | McWade | 271/131 X |
| 3,923,297 | 12/1975 | Barny | 271/132 |

*Primary Examiner*—Richard A. Schacher
*Attorney, Agent, or Firm*—Louis E. Marn; Elliot M. Olstein

[57] ABSTRACT

Apparatus for separating and removing a sheet from a stack of such sheets is provided with a reciprocating pushing member engaging the trailing edge of the lowermost sheet in the stack to push the same into contact with transport means capable of engaging the leading edge of the sheet for further transportation thereof. The pushing member has a pushing surface extending perpendicular to the surface supporting the stack and with a lower edge which, in the operative position of the pushing member, is substantially at the level of the stack supporting surface. The apparatus is particularly suitable for feeding film sheets from a cassette at a relatively high rate.

1 Claim, 2 Drawing Figures

APPARATUS FOR SEPARATING AND REMOVING A SHEET FROM A STACK OF SUCH SHEETS

Figure 1:
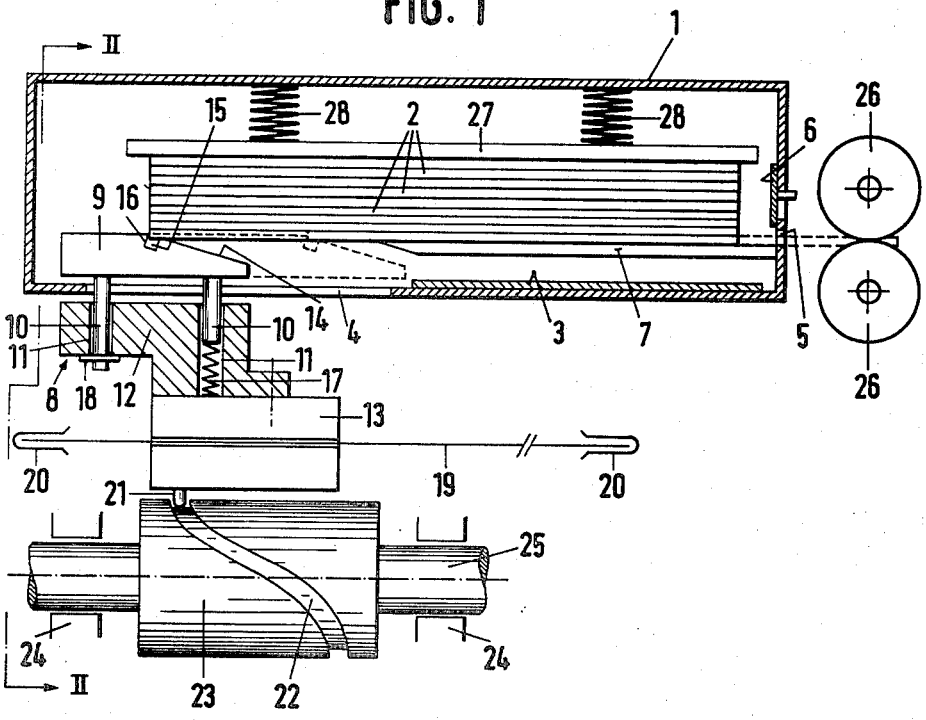

This invention relates to an apparatus for separating and removing a sheet from a stack of such sheets, which stack is supported on a supporting surface formed by at least two support members arranged substantially in the area of its longitudinal edges, which apparatus further comprises separating means for engaging the lowermost sheet in the stack and consisting of at least one pushing member reciprocating in a desired direction of transport and arranged to bring the sheet into contact with transporting means disposed at the rear of the stack for taking over the transport of the sheet initiated by the pushing member.

Such an apparatus is described in Dutch patent application No. 7406745. In this prior apparatus, the separating means consist, on the one hand, of a pair of upsetting members disposed on opposite sides of the stack of sheets behind the support members and capable of engaging the lowermost sheet to bulge it away from the stack by being moved towards one another. On the other hand, there is provided a hook member reciprocating in the direction of transport and capable of catching behind the trailing edge of a bulged sheet, thereby pushing it in the direction of, and into contact with, a set of rollers disposed behind the stack, whereafter the rollers provide for further transportation of the sheet.

Although the prior apparatus has been used with satisfactory results, it has been found that the rate of separating and removing film sheets is limited to a maximum of about 12 sheets per second.

It is one object of the present invention to considerably increase the maximum number of sheets to be processed per second, and it is another object to simplify the apparatus.

According to the present invention, these objects are achieved in an apparatus defined in the opening paragraph of this specification in that the pushing member has a pushing surface extending substantially perpendicular to the supporting surface and with a lower edge which, in the operative position of the pushing member, is substantially at the level of the supporting surface, said pushing surface being arranged to act in direct engagement with the trailing edge of the lowermost sheet of the stack.

Owing to these measures being taken, the bulging step and the provisions required for it in the apparatus are no longer applied. In fact, it has been found that during the upsetting step a sheet does not bulge regularly, but in an undulatory manner, whereafter, as it were, it springs into the bulged form. The corrugated form has been found to be the result of vacuum being drawn during the upsetting step, which interferes with the expected arcuate bulge of a sheet. The higher the upsetting velocity, the stronger is this adverse effect. Consequently, the upsetting speed is limited to a maximum. If the speed becomes too high, the forces occurring during the drawing of the vacuum would become so strong that the sheet is liable to be torn.

In the apparatus according to the present invention, not only is this adverse effect prevented, but it is even turned into a positive effect on the operation of the apparatus. Where the pushing surface of the pushing member engages direct with the trailing edge of the sheet, it is of importance that the sheet remains flat during the separation and removal from the stack. Now, this is promoted in an advantageous manner by the vacuum effect, which in fact prevents bulging of the sheet. Thus the measures taken in accordance with the principles of the present invention not only result in simplication of the separator, but also surprisingly turn a negative effect into a positive one. Indeed, the number of sheets to be processed per unit of time is considerably higher with the apparatus according to the present invention than it is with the apparatus of the prior art. With the separator according to this invention, rates as high as 27 sheets per second have been achieved, which is more than twice the rate achieved in the prior art.

In a further embodiment of the present invention, the pushing member is resiliently received, in a direction perpendicular to the supporting surface, in a member arranged for controlled reciprocating movement. It is thereby achieved that the tolerances of the various elements are no longer so critical. In this connection one may be thinking of the tolerances between the supporting members, on the one hand, and the pushing member with its co-operating parts, on the other. When the stack of sheets is contained in a cassette, the dimensioning between cassette and separator, too, is no longer tied down to very narrow tolerances. This is all the more important considering that in that case a separator must be able of co-operating with a great variety of cassettes.

The co-operation between the pushing member and the lowermost sheet in a stack can be still further improved by providing the pushing member with at least one pin extending at right angles to the supporting surface into a corresponding guide in the member arranged for controlled reciprocating movement, which pin is biased upwardly relative to the reciprocating member by spring means, which displacement is limited by locking means.

In a preferred embodiment of the invention, the pushing member is of highly simple, but extremely effective construction and consists of a block-shaped member having part of its upper surface inclined downwardly in the direction of transport, which part is bounded by a groove formed in the upper surface of the member transversely to the direction of transport, there being a difference in height between the front and rear edges of the groove, constituting the height of the pushing surface. In this embodiment the groove can also serve, in a particularly advantageous manner, as a tool end groove in fabricating the inclined surface.

Figure 2:
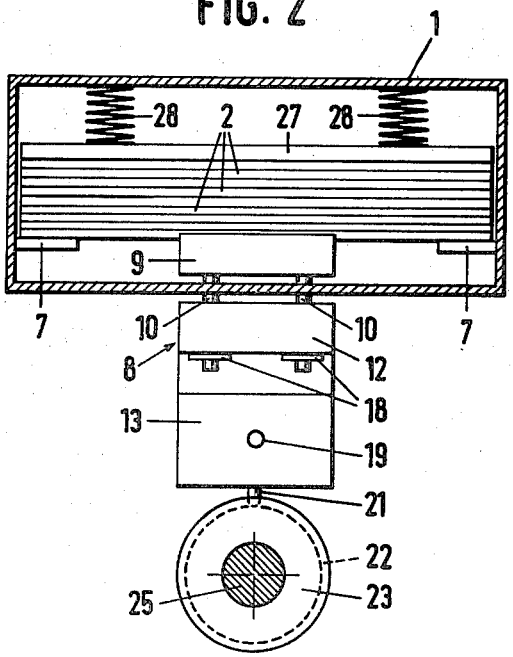

One embodiment of the present invention will now be described, by way of example, with reference to the accompanying drawings. In said drawings, FIG. 1 shows a diagrammatic, cross-sectional view of an apparatus according to the present invention; and FIG. 2 is a cross-sectional view taken on the line II—II of FIG. 1, with some parts being omitted for clarity.

Referring to the drawings, there is shown a cassette 1 in which a stack of sheets, for example, film sheets 2, can be accommodated. The cassette generally consists of a closed box having an opening 4 that can be closed with a slide 3. The cassette further comprises a discharge slit 5 that can be closed with a slide 6, and a pair of supports 7 for the stack of sheets.

Extending through opening 4, which can be used for loading the cassette, i.e. introducing a stack of film sheets therein, is a pushing member 8 consisting of a block-shaped element 9 mounting a plurality of guide pins 10 extending into guides 11 of a guide block 12 rigidly connected to a slide block 13.

Element 9 is provided with an inclined surface 14 terminating in a groove 15 formed so that the upper edge contiguous with the inclined surface is lower than the other upper edge, with the groove surface contiguous with the latter upper edge serving as the pushing surface as will be described in more detail hereinafter.

Element 9 is biased towards the stack of film sheets 2 by means of one or more springs 17 accommodated in guides 11 under pins 10 present under the inclined surface 14. To prevent unintentional detachment of element 9 and block 12, these are locked relative to each other by means of one or more locking rings 18 applied to the pins 10 not loaded by a spring.

Slide block 13 is mounted on a horizontal guide 19, shown diagrammatically only, which guide is connected to the housing, not shown, of the separator by means of fastenings 20. Block 13 is further provided with a follower pin 21 capable of co-operating with a camming groove 22 formed in a cylindrical body 23. A motor not shown drives body 23 via a shaft 25 journalled in bearings 24. This motor can also serve to drive a set of rollers 26 arranged in juxtaposition to the discharge slot.

The stack of film sheets 2 is on one side supported by supports 7, while the other side is in contact with a plate 27 which is kept continuously in contact with the stack by means of springs 28. As a consequence the cassette and the separator can be disposed in every possible position relative to the horizontal.

The operation of the apparatus is as follows:

After a cassette 1 with a stack of film sheets 2 therein has been placed in the position shown in FIG. 1, the motor of the separator can be switched on for removing the sheets from the cassette one by one.

The motor will rotate shaft 25 and hence cylinder 23. The result is that, through co-operation of pin 21 and groove 22, block 13 will be moved to the right, as viewed in FIG. 1, over guide 19. Together with block 13, pushing member 8, which is connected with it, will also be moved to the right, so that, as a consequence of pushing surface 16 engaging with the trailing edge of the lowermost sheet in the stack of film sheets 2 in cassette 1, this film sheet will be pushed to the right over supports 7. The film sheet will then leave cassette 1 through slot 5 and come into contact with rollers 26, which are continuously driven by the motor of the separator, and which take over further transportation of the film sheet from the cassette from pushing member 8.

When transportation of the film sheet has been taken over by rollers 26, further rotation of shaft 25 will cause block 13 and hence pushing member 8 to be returned back into the starting position shown in FIG. 1 through co-operation of pin 21 and groove 22. This means that during one revolution of shaft 25 a film sheet is discharged and also the separator is back in its starting position ready for separating a next film sheet.

Owing to the resilient mounting of the block-shaped element 9 in guide block 12, it is ensured, on the one hand, that during the return movement of pushing member 8 the then-lowermost sheet of the stack of film sheets 2 will not be damaged or scratched. On the other hand it is ensured that the contact between the trailing edge of the lowermost film sheet and pushing surface 16 will always be optimal. The separator and the cassettes to be placed therein have thus become rather insensitive to manufacturing tolerances. In this connection it should be noted that, in the absence of the possibility of adaptation of element 9, both the guides between the separator's housing and cassette(s) and the relative positions of supports 7 in the cassette would be subject to extremely narrow tolerances.

It will be clear that a great many alterations and modifications are possible without departing from the scope of the invention. Thus, rollers 26 can be replaced by a clamp engaging with the leading edge of the film sheet and transporting it further. Also, the block-shaped element can be provided with a vertically adjustable blade member with an edge projecting from the element to serve as a pushing surface instead of surface 16 of groove 15. Furthermore the connection between the block-shaped element 9 and guide block 12 can be formed by leaf springs instead of pins 10 and coil springs 11. This connection can also be effected using a single pin which, in addition to being spring-urged for limited movability should be locked from rotation around its axis. This can be realized in a simple manner by making the pin of non-circular cross-sectional configuration.

I claim:

1. An apparatus for separating and removing a sheet from a stack of sheets which comprises:

support means for supporting said stack of sheets about longitudinal edges thereof; and pushing means for engaging the lowermost sheet in said stack reciprocating in a direction of transport between a point at which the lowermost sheet contacts a pushing surface of said pushing means at the rear of said stack for the transport of said lowermost sheet to a point of further transport of said sheet, said pushing means being comprised of a block-shaped member having an upper surface inclined downwardly to the direction of transport and having a groove formed in said upper surface transverse to said direction of transports, said groove having a difference in height between a front and rear edge thereof thereby forming said pushing surface, said pushing means being provided with at least one pin extending at right angles to said upper surface and disposed in a guide in a reciprocating drive member arranged for controlled reciprocating movement, said pin being spring-biased upwardly relative to said reciprocating drive member.

* * * * *